US006822393B2

(12) United States Patent
Kim

(10) Patent No.: US 6,822,393 B2
(45) Date of Patent: Nov. 23, 2004

(54) PLASMA DISPLAY PANEL

(75) Inventor: Jae Sung Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 9 days.

(21) Appl. No.: 10/029,303

(22) Filed: Dec. 28, 2001

(65) Prior Publication Data

US 2002/0084751 A1 Jul. 4, 2002

(30) Foreign Application Priority Data

Dec. 29, 2000 (KR) ..... P2000-85034

(51) Int. Cl.[7] ..... H01J 17/49
(52) U.S. Cl. ..... 313/582; 313/473; 313/584
(58) Field of Search ..... 313/582, 473, 313/112, 587, 631

(56) References Cited

FOREIGN PATENT DOCUMENTS

JP 10-283937 10/1998

*Primary Examiner*—Vip Patel
(74) *Attorney, Agent, or Firm*—Fleshner & Kim, LLP

(57) ABSTRACT

A plasma display panel including a pair of panels, pairs of sustain electrodes arranged on one of the panels and bus electrodes formed to be at least partially overlapped on the transparent electrodes, and address electrodes arranged to intersect the pairs of sustain electrodes, wherein a plurality of cells are formed on intersecting points of the pairs of sustain electrodes and the address electrodes. Also including, fluorescent layers, wherein a light absorption layer is formed on a side of each bus electrode directing the inside of the cell.

20 Claims, 4 Drawing Sheets

【FIG. 1】
RELATED ART
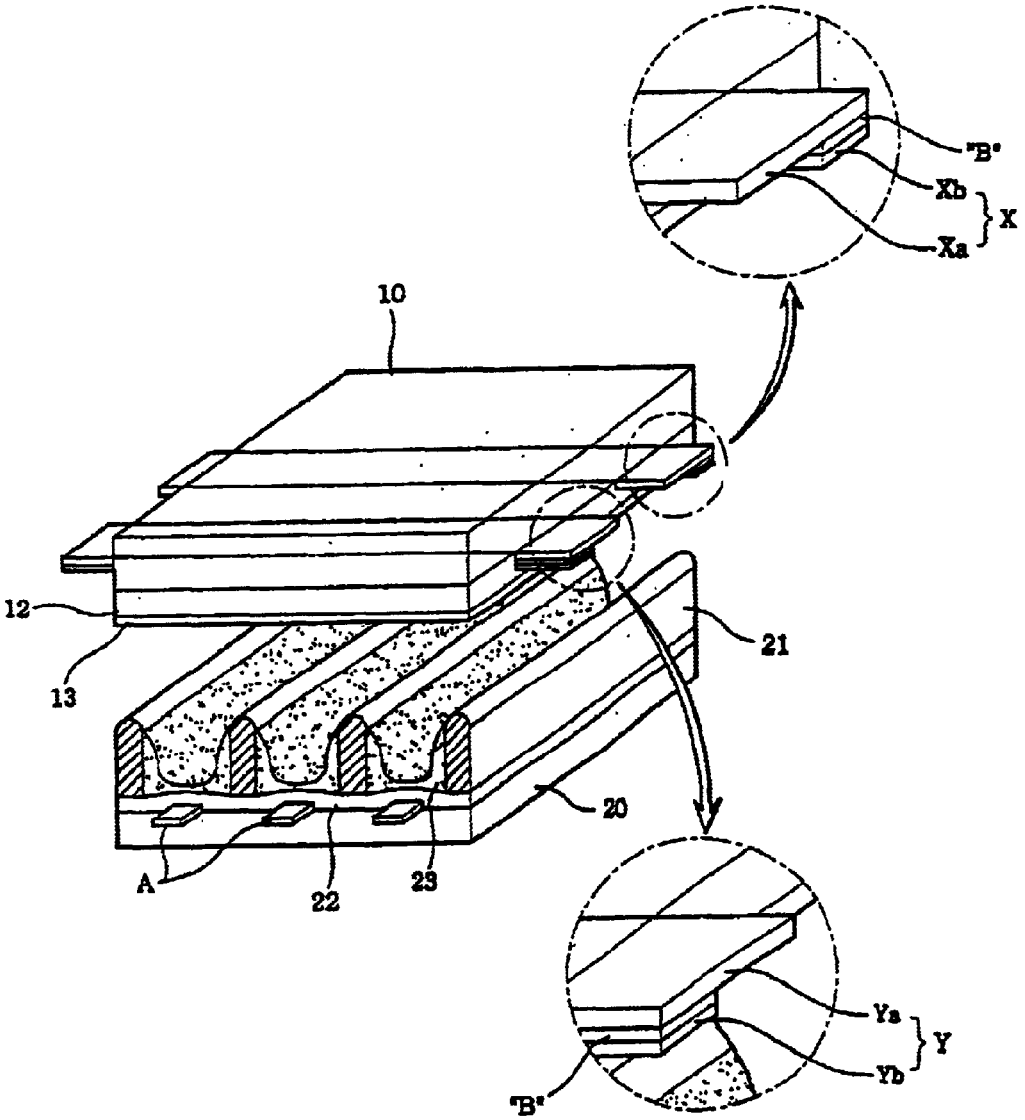

【FIG. 2】
RELATED ART
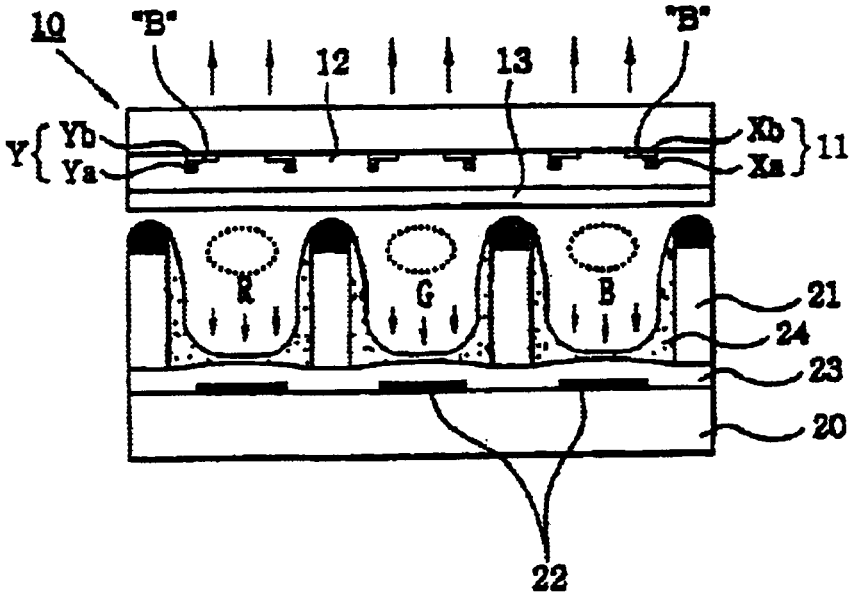

【FIG. 3】
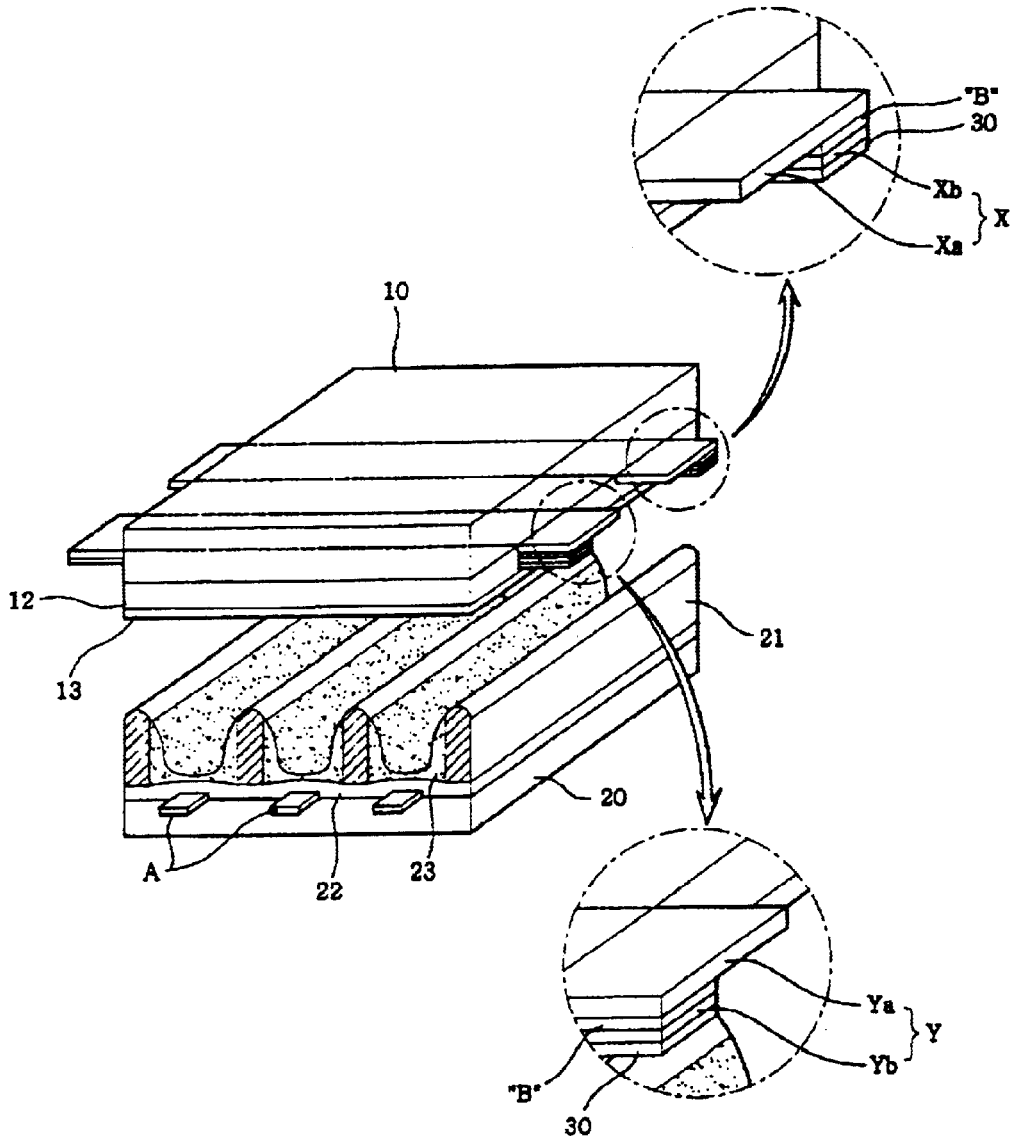

【FIG. 4】
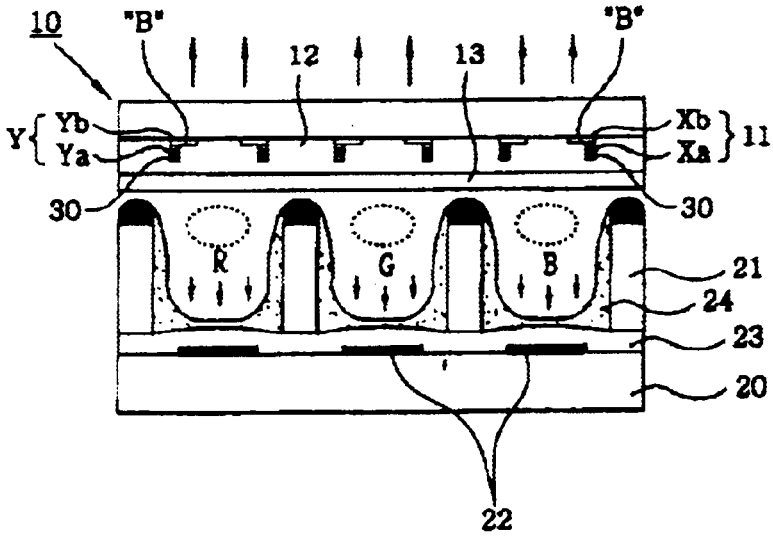

PLASMA DISPLAY PANEL

BACKGROUND OF THE INVENTION

1. Field of the Invention

The present invention relates to a plasma display panel, and more particularly, to a plasma display panel capable of improving color purity and contrast by preventing light emitted from fluorescent layers from being reflected by a side of each bus electrode again when ultraviolet rays excite the fluorescent layer of the inside of each cell and the light is emitted from the fluorescent layer.

2. Background of the Related Art

FIG. 1 is an exploded perspective view showing a state that a conventional plasma display panel is separated, and FIG. 2 is a sectional view showing an arrangement state of electrodes.

A rear panel 20 shown in FIG. 2 is rotated at an angle of 90 degrees to a front panel 10.

A plasma display panel is that the front panel 10, which is a display surface for displaying image, and the rear panel 20, which forms a rear surface of the plasma display panel, are coupled parallel at a certain distance from each other.

On a side of the front panel 10, arranged are sustain electrodes for maintaining the light emission of the cells by mutual electric discharge in one pixel, that is, common sustain electrodes X and scan sustain electrodes Y, which are forms a pair respectively. The sustain electrodes include transparent electrodes (or ITO electrodes) Xa and Ya made of transparent Indium Tin Oxide material and bus electrodes Xb and Yb made of metal material, and a black layer B, which is made of ruthenium oxide ($RU_2O$) and red lead (PbO) or carbon group, is formed between the transparent electrodes and the bus electrodes.

Furthermore, the common sustain electrodes X and the scan sustain electrodes Y are covered with a dielectric layer 12 for restricting discharge current and insulating between the pairs of electrodes, and a protection layer 13 is formed on an upper surface of the dielectric layer 12.

Moreover, the scan sustain electrode Y carries out a function of a scan electrode for forming wall charge by causing electric discharge during an initial operation of the plasma display panel and the common sustain electrode X carries out a function of a common electrode for applying AC voltage during the electric discharge.

The rear panel 20 includes barrier 21 of a stripe type (or a dot type) arranged parallel for forming a plurality of discharge spaces, i.e., the cells C, a plurality of address electrodes A arranged parallel to the barrier 21 at portions intersecting with the sustain electrodes 11 for performing address discharge to generate vacuum ultraviolet rays, and a dielectric layer 22 formed on upper portions of the address electrodes.

Additionally, on an upper surface of the rear panel, i.e., the surface besides the upper end surfaces of the barrier 21, covered are red, green and blue (R, G and B) fluorescent layers 23 to emit visible rays for displaying image.

An image display process of the cells of a conventional PDP having the above structure will be described in brief.

Initially, if voltage of 150V~300V is supplied between the scan sustain electrode Y and the address electrode A inside an arbitrary discharge cell, writing discharge is generated in the inside of the cell located between the scan sustain electrode Y and the address electrode A, and thereby wall charge is formed on the dielectric layer adjoining the inside of the corresponding discharge space.

After that, if discharge voltage above 150V is supplied to the corresponding common sustain electrode X and scan sustain electrode Y, sustain discharge is generated between the common sustain electrode X and the scan sustain electrode Y in the corresponding cell.

That is, the electric discharge between the electrodes generates electric field inside the cell, and thereby a small amount of electrons in discharge gas are accelerated. The accelerated electrons and neutral particles in gas come into collision, thereby being ionized into electrons and ions. The ionized electrons come into collision with neutral particles, and the neutral particles are rapidly ionized into electrons and ions, so that the discharge gas is made into a plasma condition, and at the same time, vacuum ultraviolet rays are generated.

The generated ultraviolet rays excite the fluorescent layers 23 to generate visible rays. If the generated visible rays are emitted to the outside through the front panel 10, the emission of the arbitrary cell, i.e., the image display may be recognized from the outside.

However, in the front panel of the plasma display panel, especially, the bus electrodes Xb and Yb formed on the front panel 10 causes the following problem.

A side of each bus electrode Xb and Yb adjoining the dielectric layer 12 faces the inside of the cell C and has a peculiar color of silver (Ag).

Therefore, when the ultraviolet rays excite the fluorescent layer 23 inside the cell C and generate the visible rays, the side of each bus electrode Xb and Yb reflects the light reflected from the fluorescent layer 23 again, and thereby the light reflected again is displayed on the display surface of the front panel 10, which is the outside of the cell C.

As a result, silver (Ag) forming the bus electrodes Xb and Yb has its own peculiar color, and the color of the light reflected is not even due to the property of the bus electrodes when the bus electrodes Xa and Ya reflects again the light emitted from the fluorescent layers of R, G and B colors. Especially, because the B (Blue) light is relatively reflected less, when a user sees a screen in an off condition of the cell C, the screen shows somewhat yellow color as a whole.

Therefore, the conventional plasma display panel has several problems that the color purity generated on the fluorescent layer itself is deteriorated and that the contrast is deteriorated if the product is installed on a place where there is external light.

The above problems are severer when plural pairs of sustain electrodes in a single cell exist.

SUMMARY OF THE INVENTION

Accordingly, the present invention is directed to a plasma display panel that substantially obviates one or more problems due to limitations and disadvantages of the prior art.

An object of the present invention is to provide a plasma display panel capable of improving color purity by preventing light emitted from fluorescent layers from being reflected by a side of each bus electrode again when ultraviolet rays excite the fluorescent layer of the inside of each cell and the light is emitted from the fluorescent layer.

Another object of the present invention is to provide a plasma display panel capable of improving contrast by absorbing light emitted inside the cell through the bus electrode directing the inside of the cell.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a plasma display panel includes: a pair of panels facing at a prescribed interval from each other; sustain electrodes having a plurality of transparent electrodes arranged on one of the panels and bus electrodes formed to be at least partially overlapped on the transparent electrodes, the sustain electrodes being in pairs; address electrodes arranged to intersect the pairs of sustain electrodes; a plurality of cells formed on intersecting points of the pairs of sustain electrodes and the address electrodes; barrier formed between the panels for dividing the cells; and fluorescent layers arranged between the barrier, wherein a light absorption layer for absorbing light of each fluorescent layer formed on the cell is provided on a side of each bus electrode directing the inside of the cell.

Preferably, the light absorption layer is formed by mixing and firing ruthenium oxide ($RU_2O$) and lead oxide (PbO)

Preferably, the light absorption layer is formed by firing carbon.

Preferably, the light absorption layer has conductivity.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 illustrates an exploded perspective view of a plasma display panel having conventional bus electrodes;

FIG. 2 illustrates a sectional view showing a coupled state of the plasma display panel having the conventional bus electrodes;

FIG. 3 illustrates an exploded perspective view of a plasma display panel having bus electrodes according to the present invention; and FIG. 4 illustrates a sectional view showing a coupled state of the plasma display panel having the bus electrodes according to the present invention.

DETAILED DESCRIPTION OF THE PREFERRED EMBODIMENT

Reference will now be made in detail to the preferred embodiments of the present invention, examples of which are illustrated in the accompanying drawings.

For reference, like reference characters designate corresponding parts throughout several views.

FIGS. 3 and 4 are an exploded perspective view and a sectional view of essential parts, in a state that bus electrodes according to the present invention are mounted on a front panel.

As shown in the drawings, the plasma display panel according to the present invention includes the front panel 10, which is a display surface for displaying image, and a rear panel 20, which forms a rear surface, and the front panel 10 and the rear panel 20 are coupled parallel in a prescribed interval from each other.

On a side of the front panel 10, arranged are sustain electrodes for maintaining the light emission of a cell by mutual electric discharge in one pixel, that is, common sustain electrodes X and scan sustain electrodes Y, which are forms a pair respectively. The sustain electrode includes transparent electrodes (or ITO electrodes) Xa and Ya made of transparent Indium Tin Oxide material and bus electrodes Xb and Yb made of metal material. A black layer B, which is made of ruthenium oxide ($RU_2O$) and lead oxide (PbO) or carbon group, is formed between the transparent electrodes and the bus electrodes. Moreover, a light absorption layer 30, which is made by mixing and firing ruthenium oxide ($RU_2O$) and lead oxide (PbO), is formed on the bus electrodes.

Furthermore, the common sustain electrodes X and the scan sustain electrodes Y are covered with a dielectric layer 12 for restricting discharge current and insulating between the pairs of electrodes, and a protection layer 13 is formed on an upper surface of the dielectric layer 12.

Moreover, the scan sustain electrode Y and the common sustain electrode X carries out a function for sustaining electric discharge by applying AC voltage during the electric discharge.

The rear panel 20 includes barrier 21 of a stripe type (or a dot type) arranged parallel for forming a plurality of discharge spaces, i.e., the cells C, a plurality of address electrodes A arranged parallel to the barrier 21 at portions intersecting with the sustain electrodes 11 for performing address discharge to generate vacuum ultraviolet rays, and a dielectric layer 22 formed on upper portions of the address electrodes.

Additionally, on an upper surface of the rear panel, i.e., the surface besides the upper end surfaces of the barrier 21, covered are R, G and B (Red, Green and Blue) fluorescent layers 23 to emit visible rays for displaying image during the discharge. The structure of the fluorescent layers of the plasma display panel according to the present invention is very similar to that of the conventional plasma display panel.

The feature of the present invention is that the light absorption layer 30 for absorbing the light of the fluorescent layers 23 formed on the cell C is disposed on one side of each bus electrode Xb and Yb directing the inside of the cell C.

The light absorption layer 30 is formed by mixing and firing ruthenium oxide ($RU_2O$) and lead oxide (PbO) or by firing carbon.

Furthermore, in respect of a function of the bus electrodes, it is preferable to manufacture the light absorption layer 30 with conductive material.

An image display process according to the present invention is very similar to an image display process of the conventional plasma display panel, and therefore, the repetition of the same part of the image display process will be avoided and only distinguishing parts and relative parts will be described.

If sustain discharge voltages are applied alternately to the common electrodes and the scan sustain electrodes X and Y, electric discharge occurs in the inside of the cell C so as to generate ultraviolet rays, and the generated ultraviolet rays excite the fluorescent layer 23 of the inside of the cell C to generate visible rays. At this time, because the light absorption layer 30, which is made of the same material as the black layer B, is formed on one side of each bus electrode Xb and Yb directing the inside of the cell C, the light absorption layer 30 prevents irregular reflection of the light by the bus electrodes by absorbing the light reflected from the fluorescent layer 23.

Therefore, the present invention can improve color purity and contrast indicated by the R, G and B fluorescent layers by absorbing the light emitted from the fluorescent layers 23 into the light absorption layers 30.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A plasma display panel comprising:

a pair of panels facing at a prescribed interval from each other;

sustain electrodes having a plurality of transparent electrodes arranged on one of the panels and bus electrodes formed to be at least partially overlapped on the transparent electrodes, the sustain electrodes being in pairs;

address electrodes arranged to intersect the pairs of sustain electrodes;

a plurality of cells formed on intersecting points of the pairs of sustain electrodes and the address electrodes;

barrier formed between the panels for dividing the cells; and fluorescent layers arranged between the barrier, wherein a light absorption layer for absorbing light of each fluorescent layer formed on the cell is provided on a side of each bus electrode directing the inside of the cell.

2. The plasma display panel according to claim 1, wherein the light absorption layer comprises ruthenium oxide ($Ru_2O$) and lead oxide (PbO).

3. The plasma display panel according to claim 1, wherein the light absorption layer comprises carbon.

4. The plasma display panel according to claim 1, wherein the light absorption layer is conductive.

5. The plasma display panel according to claim 1, wherein the side of each bus electrode directing the inside of the cell is the side of each bus electrode which faces the address electrodes.

6. The plasma display panel according to claim 1, further comprising a black layer, wherein each bus electrode has a black layer on one side and a light absorption layer on the other side.

7. The plasma display panel according to claim 1, further comprising a black layer, wherein each sustain electrode includes a transparent electrode, a bus electrode, a black layer, and a light absorption layer.

8. A plasma display panel, comprising:

a first and a second panel facing each other;

sustain electrodes comprising:

a transparent electrode on the first panel;

a bus electrode on the transparent electrode; and a light absorption layer on the opposite side of the bus electrode from the transparent electrode; and address electrodes on the second panel.

9. The plasma display panel according to claim 8, wherein the light absorption layer comprises ruthenium oxide ($Ru_2O$) and lead oxide (PbO).

10. The plasma display panel according to claim 8, wherein the light absorption layer comprises carbon.

11. The plasma display panel according to claim 8, wherein the light absorption layer is conductive.

12. The plasma display panel according to claim 8, wherein the light absorption layer is on the side of each bus electrode which faces the address electrodes.

13. The plasma display panel according to claim 8, further comprising a black layer, wherein the bus electrode has a black layer on one side and a light absorption layer on the other side.

14. The plasma display panel according to claim 8, wherein the sustain electrodes further comprise black layers.

15. A plasma display panel, comprising:

a first and a second panels facing each other;

sustain electrodes comprising at least four layers including a light absorption layer; and address electrodes on the second panel.

16. The plasma display panel according to claim 15, wherein said at least four layers include at least two light absorption layers.

17. The plasma display panel according to claim 15, wherein said at least four layers include:

a transparent electrode;

a bus electrode;

a black layer; and a light absorption layer.

18. The plasma display panel according to claim 15, wherein the light absorption layer comprises ruthenium oxide ($Ru_2O$) and lead oxide (PbO).

19. The plasma display panel according to claim 15, wherein the light absorption layer comprises carbon.

20. The plasma display panel according to claim 15, wherein said at least four layers include:

a transparent electrode on the first panel;

a bus electrode on the transparent electrode;

a black layer between the transparent electrode and the bus electrode; and a light absorption layer located between the bus electrode and the address electrodes.

* * * * *